US011905696B2

(12) United States Patent
Huang et al.

(10) Patent No.: US 11,905,696 B2
(45) Date of Patent: Feb. 20, 2024

(54) DUAL WATER-VESSEL FLUSH STRUCTURE AND PRESSURE-ASSISTED TOILET FLUSH SYSTEM

(71) Applicant: ECO (XIAMEN) TECHNOLOGY INC., Fujian (CN)

(72) Inventors: Bingxing Huang, Xiamen (CN); Dongsheng Zhang, Xiamen (CN)

( * ) Notice: Subject to any disclaimer, the term of this patent is extended or adjusted under 35 U.S.C. 154(b) by 0 days.

(21) Appl. No.: 17/970,574

(22) Filed: Oct. 21, 2022

(65) Prior Publication Data

US 2023/0313514 A1 Oct. 5, 2023

(30) Foreign Application Priority Data

Mar. 29, 2022 (CN) ..... 202220720313.4
Aug. 11, 2022 (CN) ..... 202222115337.X

(51) Int. Cl.
*E03D 3/10* (2006.01)

(52) U.S. Cl.
CPC ..... *E03D 3/10* (2013.01)

(58) Field of Classification Search
CPC ..... E03D 3/10; E03D 1/302
USPC ..... 4/332, 334, 354, 362, 363
See application file for complete search history.

(56) References Cited

U.S. PATENT DOCUMENTS 7,171,701 B2 * 2/2007 Kuster ..... E03D 3/10 4/359
2014/0208497 A1 * 7/2014 Li ..... E03D 3/10 4/362
2021/0355667 A1 * 11/2021 Jensen ..... E03D 3/10

FOREIGN PATENT DOCUMENTS

CN 110139964 A * 8/2019 ..... E03D 3/10

* cited by examiner

*Primary Examiner* — Tuan N Nguyen

(57) ABSTRACT

A dual water-vessel flush structure and a pressure-assisted toilet flush system are disclosed. The dual water-vessel flush structure includes first and second vessels and a communicating pipe. The first vessel at an upper part thereof is provided with a water supplement hole and an air supplement hole. The second vessel at a lower part thereof is provided with a water outlet. The first and second vessels are mutually communicated at bottoms of laterals thereof through the communicating pipe. The pressure-assisted toilet flush system includes a dual water-vessel flush structure, a water-air supplement mechanism, a water drainage mechanism, and a control mechanism. The water supplement hole and the air supplement hole both lead to the first vessel through the water-air supplement mechanism. The water drainage mechanism is configured at the water outlet and interacts with the control mechanism.

15 Claims, 6 Drawing Sheets

DUAL WATER-VESSEL FLUSH STRUCTURE AND PRESSURE-ASSISTED TOILET FLUSH SYSTEM

BACKGROUND OF THE INVENTION

1. Technical Field

The present invention relates to pressure-assisted toilet flush systems, and more particularly to a dual water-vessel flush structure and a pressure-assisted toilet flush system.

2. Description of Related Art

Conventionally, a pressure-assisted toilet flush system for a sitting toilet accumulates pressure energy in the form of compressed air within a pressure-assisted flush water tank and releases the pressure energy during drainage, so as to enable water in the pressure-assisted flush water tank to clean the toilet pan with a strong flush force.

In addition to the pressure-assisted toilet flush water tank that stores water and air, such an existing pressure-assisted flush system is composed of numerous components, such as a control mechanism, a drainage valve, an air supplement valve, a pressure regulating valve, and a water split box, making the overall structure too complicated and bulky to be easily fit in the limited space reserved behind the toilet pan. Moreover, installation of the pressure-assisted flush water tank tends to be hindered by the soil pipe of the sitting toilet, in which case the installation can be quite time-consuming and effort-consuming.

SUMMARY OF THE INVENTION

The objective of the present invention is to provide a dual water-vessel flush structure and a pressure-assisted toilet flush system, which are advantageous for being compact in terms of volume and flexible in terms of installation, thereby solving the problems of the existing pressure-assisted toilet flush systems about bulkiness and troublesome installation.

To achieve the foregoing objective, a solution adopted by the present invention is:

a first vessel, a second vessel, and a communicating pipe; the first vessel at an upper part thereof provided with a water supplement hole and an air supplement hole; the second vessel at a lower part thereof provided with a water outlet, and the first vessel at a bottom of a lateral thereof communicated with a bottom of a lateral of the second vessel through the communicating pipe; whereby for water supplement, water flows into the first vessel through the water supplement hole, and air flows into the first vessel through the air supplement hole, so that the water and the air mix together before flowing into the second vessel through the communicating pipe, and the air is gradually compressed while being stored in the upper parts of the first and second vessels; and for water drainage, the compressed air pushes the water in the first vessel to flow into the second vessel through the communicating pipe and pushes the water in the second vessel to drain through the water outlet.

The water supplement hole is configured at a top of the lateral of the first vessel, and the air supplement hole is configured on an upper end surface of the first vessel, and the water outlet is configured at the bottom of the lateral of the second vessel.

The dual water-vessel flush structure further comprises an importing pipe configured inside the first vessel and extending to a lower part of the first vessel, wherein the water supplement hole and the air supplement hole are both communicated with the importing pipe.

The communicating pipe has a diameter not smaller than 15 mm.

Another solution adopted by the present invention is:

a pressure-assisted toilet flush system, comprising the dual water-vessel flush structure described previously, and further comprising a water-air supplement mechanism, a water drainage mechanism, and a control mechanism; the water supplement hole and the air supplement hole both leading to the first vessel through the water-air supplement mechanism; the water drainage mechanism being configured at the water outlet, and interacting with the control mechanism; and the control mechanism working to activate the water drainage mechanism to perform water drainage at the water outlet.

The water-air supplement mechanism comprises an installation cover, a piston member, and a first spring; the first vessel having an upper end surface depressing to form an installation socket, the installation socket having a bottom connected to the importing pipe; the installation cover being in seal fit with a lateral wall of the installation socket, and having an upper end surface not higher than the upper end surface of the first vessel.

Preferably, the installation cover covers a water filling channel and an air filling channel that are vertically posed abreast, the water supplement hole configured on a lateral wall of the water filling channel, the air supplement hole configured at an upper end of the air filling channel, the air filling channel having a lower end communicated with the importing pipe; the piston member movably fit inside the air filling channel; the first spring configured between the piston member and a bottom wall of the installation socket, so that a difference of pressures inside and outside the first vessel and a spring force from the first spring jointly move the piston member along and inside the air filling channel, thereby opening or closing the air supplement hole.

Preferably, the water-air supplement mechanism further comprises a Venturi nozzle inlaid at an output end of the water filling channel, in which the Venturi nozzle does not block communication between the air filling channel and the importing pipe, and an output end of the Venturi nozzle is inserted into an input end of the importing pipe.

The water drainage mechanism comprises a bottom cover and a membrane; the second vessel having a water storage chamber, a water drainage pit, and a drainpipe; the water drainage pit sinking into a bottom of the second vessel, and having an internal upper wall communicated with the water storage chamber and the drainpipe, respectively, the water outlet located at an output end of the drainpipe; the bottom cover installed in seal connection at an opening of the water drainage pit; the membrane movably fit at where the water drainage pit is communicated with the drainpipe, and working with the bottom cover to define a back-pressure chamber; the back-pressure chamber having a water supplement aperture communicating the back-pressure chamber with the water storage chamber, the back-pressure chamber further having at least one drain outlet communicated with the control mechanism, whereby when the water storage chamber feeds water, the water enters the back-pressure chamber through the water supplement aperture to increase a pressure in the back-pressure chamber, and when the drain outlet is open, the back-pressure chamber drains water to decrease the pressure so that the membrane varies with the pressure in the back-pressure chamber to come close to or go away from the drainpipe, thereby closing or opening the drainpipe.

Preferably, the water drainage mechanism further comprises a second spring received in the back-pressure chamber, and a movable seat for receiving the membrane, in which the second spring is configured between the bottom cover and the movable seat, for returning the membrane toward the drainpipe.

The control mechanism comprises at least one of a switch valve and a solenoid valve.

The pressure-assisted toilet flush system further comprises a water split box, with which an output end of the control mechanism and an output end of the water drainage mechanism are communicated, wherein the water split box is provided with at least two drainage connectors for communicating a primary flushing pipe and a rinsing water pipe of a sitting toilet.

With the technical schemes described above, the present invention provides the following technical effects:

1. The present invention improves the existing pressure-assisted flush water tank by splitting the tank into the first vessel and the second vessel that are separated from tach other, so as to overcome the defect of the existing pressure-assisted flush water tank about taking large space and being difficult to install. The first vessel and the second vessel can be separately installed at two sides of the soil pipe of the sitting toilet With the advantages of flexible installation and easy assembly, the present invention is particularly suitable for a sitting toilet to be installed with tight space constraints.
2. By having the water supplement hole and the water outlet are configured on the lateral of the first vessel and the lateral of the second vessel, respectively, the overall height of the installed, pipe-connected, dual water-vessel flush structure (i.e., the pressure-assisted flush water tank) can be minimized. The flexibility in installation makes the present invention particularly suitable for a sitting toilet with a relatively small water-tank casing.

DETAILED DESCRIPTION OF THE INVENTION

The present invention will be further explained with reference to some specific embodiments.

Figure 1:
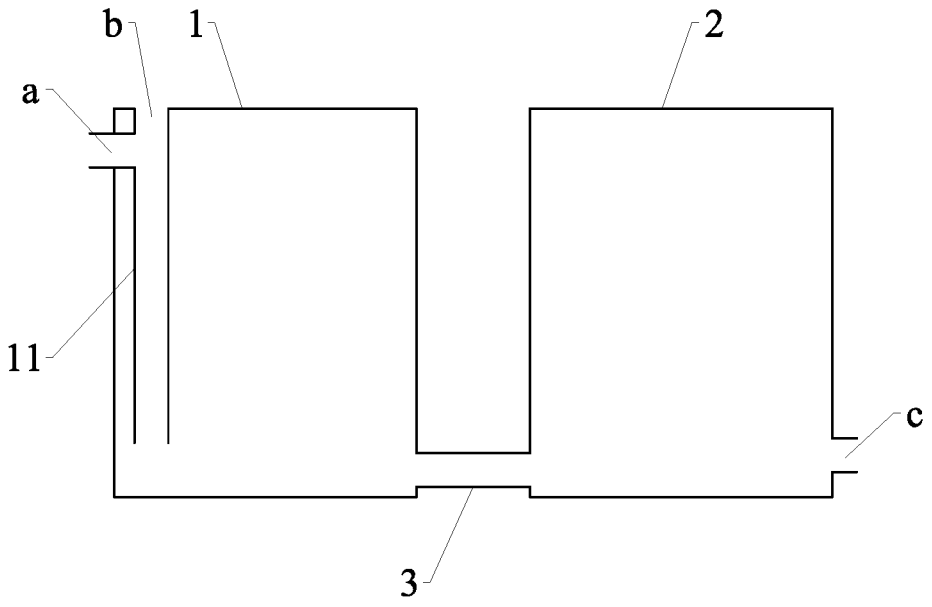
FIG. 1 depicts a schematic structure of a dual water-vessel flush structure according to an embodiment of the present invention.

As shown in FIG. 1, the present invention discloses a dual water-vessel flush structure, which comprises a first vessel 1, a second vessel 2, and a communicating pipe 3.

The first vessel 1 is at an upper part thereof provided with a water supplement hole a and an air supplement hole b. The second vessel 2 is at a lower part thereof provided with a water outlet c. The first vessel 1 at a bottom of a lateral thereof is communicated with a bottom of a lateral of the second vessel 2 through the communicating pipe 3.

For water supplement, water flows into the first vessel 1 through the water supplement hole a, and air flows into the first vessel 1 through the air supplement hole b, so that the water and the air mix together before flowing into the second vessel 2 through the communicating pipe 3. The air is gradually compressed while being stored in the upper parts of the first and second vessels 1, 2.

For water drainage, the compressed air pushes the water in the first vessel 1 to flow into the second vessel 2 through the communicating pipe 3 and pushes the water in the second vessel 2 to drain through the water outlet c.

One embodiment of the dual water-vessel flush structure will be described below.

The water supplement hole a is configured at a top of the lateral of the first vessel 1. The air supplement hole b is configured on an upper end surface of the first vessel 1. The water outlet c is configured at the bottom of the lateral of the second vessel 2.

The dual water-vessel flush structure further comprises an importing pipe 11 configured inside the first vessel 1 and extending to a lower part of the first vessel 1. The water supplement hole a and the air supplement hole b are both communicated with the importing pipe 11. The proximity of the importing pipe 11 to the bottom of the first vessel 1 facilitates the process that the mixture of the air and the water passes through the communicating pipe 3 and enters the second vessel 2 to supplement air into the second vessel 2.

The communicating pipe 3 has a diameter not smaller than 15 mm, so as to ensure the second vessel 2 with effective water supplement and air water supplement.

The communicating pipe 3 is curved away from the soil pipe of the sitting toilet. Thereby, when being installed into the water-tank casing of the sitting toilet, the communicating pipe 3 can be easily kept away from the soil pipe, and extricated from being hindered by the soil pipe.

Figure 2:
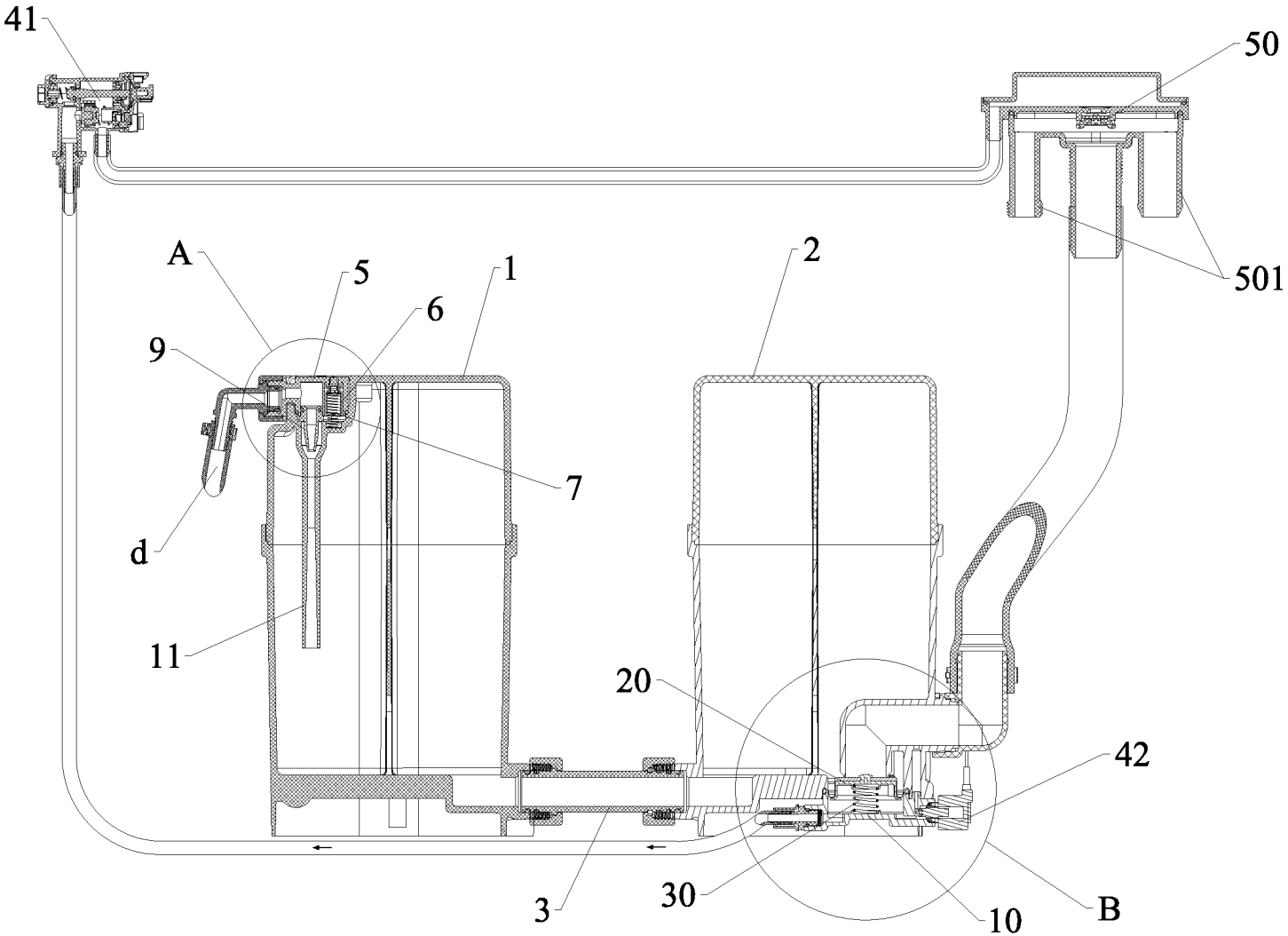
FIG. 2 depicts a schematic structure of a pressure-assisted toilet flush system according to an embodiment of the present invention.
Figure 3:
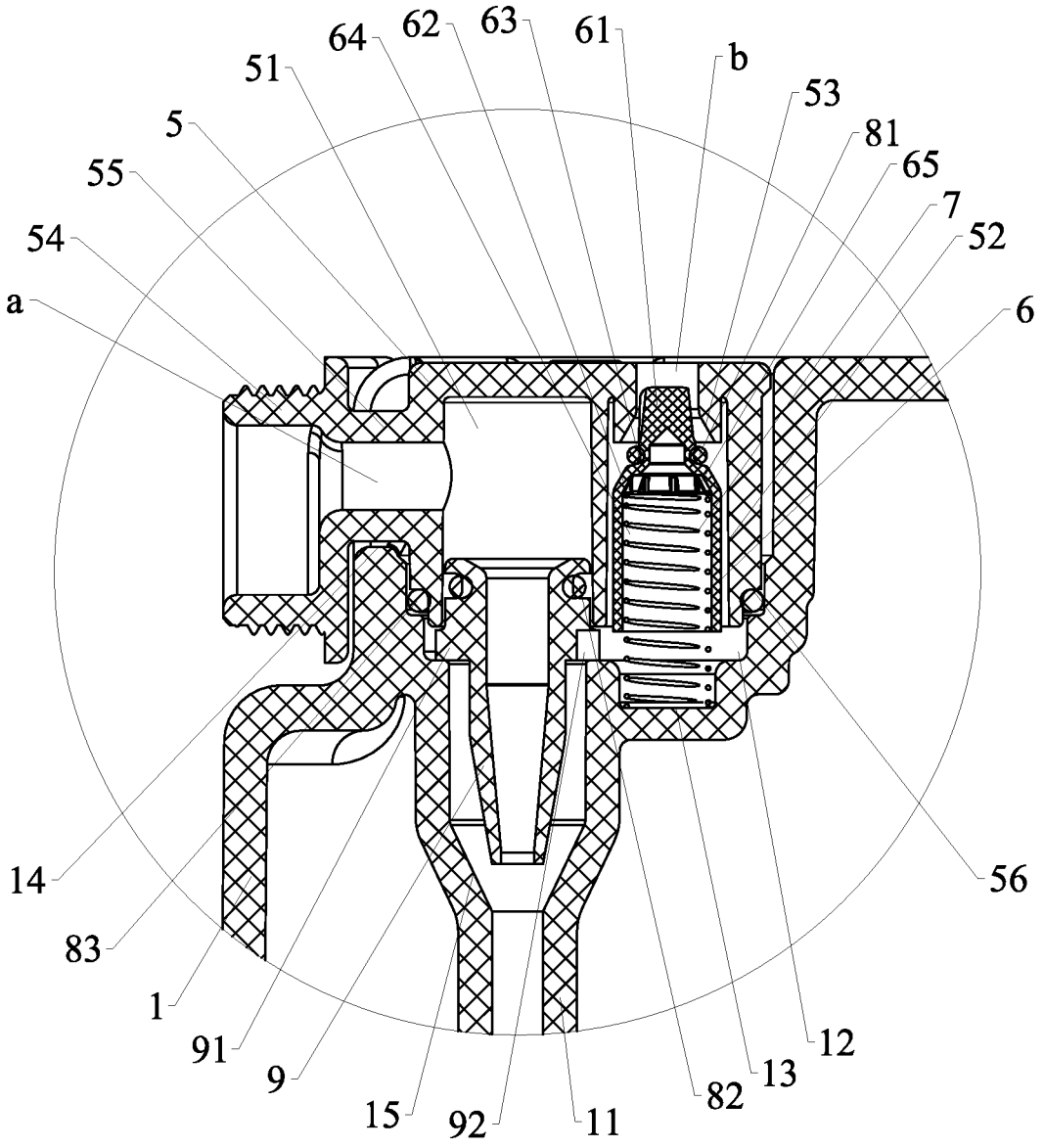
FIG. 3 is a local, close-up view of Circle A in FIG. 2.
Figure 4:
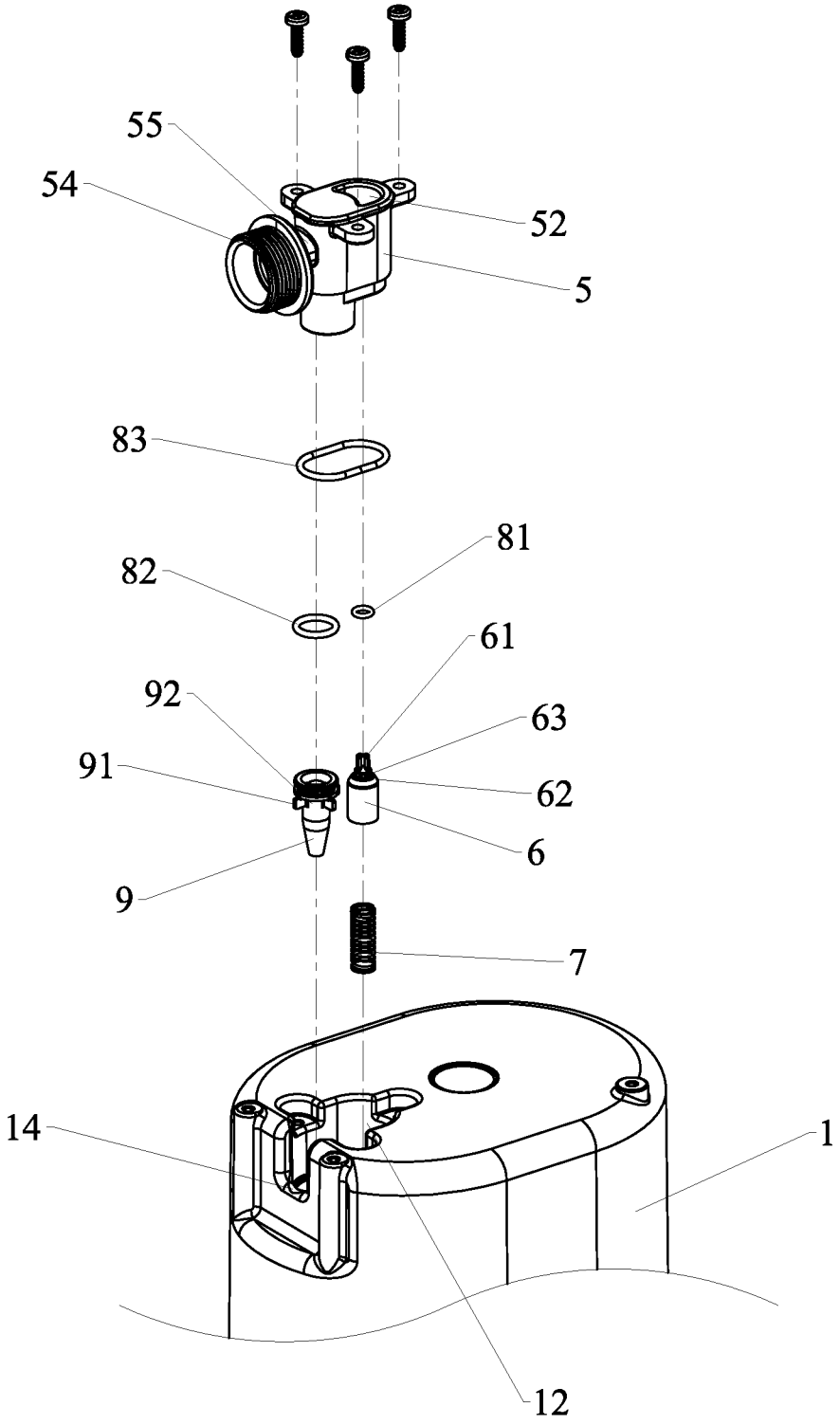
FIG. 4 is an exploded view of a first vessel and a water-air supplement mechanism according to an embodiment of the present invention.

Referring to FIG. 2 through FIG. 4, the present invention further discloses a pressure-assisted toilet flush system, which comprises the dual water-vessel flush structure as described previously, and further comprises a water-air supplement mechanism, a water drainage mechanism, and a control mechanism.

The water supplement hole a and the air supplement hole b both lead to the first vessel 1 through the water-air supplement mechanism.

The water drainage mechanism is configured at the water outlet c and interacts with the control mechanism.

The control mechanism works to activate the water drainage mechanism to perform water drainage at the water outlet c.

One embodiment of the pressure-assisted toilet flush system will be described below.

Referring to FIG. 3 and FIG. 4, the water-air supplement mechanism comprises an installation cover 5, a piston member 6, and a first spring 7. The first vessel 1 has an upper end surface depressing to form an installation socket 12. The installation socket 12 has a bottom connected to the importing pipe 11. The installation cover 5 is in seal fit with a lateral wall of the installation socket 12, and has an upper end surface not higher than the upper end surface of the first vessel 1. The installation cover 5 covers a water filling channel 51 and an air filling channel 52 that are vertically posed abreast. The water supplement hole a is configured on a lateral wall of the water filling channel 51. The air supplement hole b is configured at an upper end of the air filling channel 52. The air filling channel has a lower end communicated with the importing pipe 11. The piston member 6 is movably fit inside the air filling channel 52. The first spring 7 is configured between the piston member 6 and a bottom wall of the installation socket 12, so that a difference of pressures inside and outside the first vessel 1 and a spring force from the first spring 7 jointly move the piston member 6 along and inside the air filling channel 52, thereby opening or closing the air supplement hole b. The water-air supplement mechanism uses the installation socket 12 formed by depressing the upper end surface of the first vessel 1 to receive the installation cover 5 in which the air filling channel 52 receives the piston member 6 and the first spring 7 that form the air filling structure of the pressure-assisted toilet flush system. With such a configuration, the air filling structure is integrated with the first vessel 1 as a unity and the upper end surface of the installation cover 5 is not higher than the upper end surface of the first vessel 1, so the dual water-vessel flush structure can have its profile remaining flat and therefore suit installation subject to tight space constraints. The disclosed water-air supplement mechanism is thus superior to existing air-filling apparatuses, for it using fewer components to form a simpler structure, and being easier and more efficient to assemble.

In some embodiments of the water-air supplement mechanism, the air filling channel 52 has its upper end provided with a first circular incline 53, so that the radius of the air filling channel 52 gradually increases from the input end along the air-filling direction, like a bell. The piston member 6 has its upper end fit with a plug 61. The plug 61 borders the piston member 6 at a second circular incline 62. As the piston member 6 moves along the air filling channel 52, the second circular incline 62 come close to or go away from the first circular incline 53. The plug 61 is removably inserted into the air supplement hole b. The first circular incline 53 and the second circular incline 62 jointly increase the contact area between the piston member 6 and the wall of the air supplement hole b, so as to provide better sealness in the normal state (herein, the "normal state" referring to the state at any time after the dual water-vessel flush structure finishes water supplement and air supplement). The plug 61 serves to guide the moving piston member 6, thereby ensuring the closeness between the second circular incline 62 and the first circular incline 53.

Further, a first circular groove 63 is provided at the joint between the plug 61 and the second circular incline 62 for receiving a first seal ring 81. The first seal ring 81 moves with the piston member 6 moving in the air filling channel 52 to come close to or go away from the first circular incline 53, further enhancing the sealness between the piston member 6 and the air supplement hole b.

In some embodiments of the water-air supplement mechanism, the piston member 6 has its lower end depressing to form a first retaining recess 64, and the installation socket 12 has its bottom wall provided with a second retaining recess 13 opposite to and aligned with the first retaining recess 64. The two ends of the first spring 7 are fit in the first retaining recess 64 and the second retaining recess 13, respectively, thereby enhancing the positional stability of the first spring 7 and in turn ensuring the functional reliability of the air filling structure.

Further, the piston member 6 is a hollow, shell-like structure so as to define the first retaining recess 64. Meanwhile, first retaining recess 64 has its internal wall provided with plural stiffening ribs 65 positionally corresponding to the second circular incline 62 so that the upper end of the first spring 7 can lean on the stiffening ribs 65. The reason for making the piston member 6 as a hollow, shell-like structure is to reduce the weight of the piston member 6, so as to prevent its own gravity from excessively cancel out the spring force of the first spring 7. Additionally, the addition of the stiffening ribs 65 is to not only secure the first spring 7 in position but also to enhance the strength of the second circular incline 62 of the piston member 6.

In some embodiments of the water-air supplement mechanism, the air filling channel 52 is a passage defined inside the installation cover 5, and has a lower end forming clearance fit with the bottom wall of the installation socket 12, so as to prevent the installation socket 12 from blocking the air filling channel 52 after the installation cover 5 is installed on the first vessel 1, thereby allowing the air filling channel 52 to be communicated with the importing pipe 11.

In some embodiments of the water-air supplement mechanism, the water-air supplement mechanism further comprises a Venturi nozzle 9 inlaid at an output end of the water filling channel 51. The Venturi nozzle 9 does not block communication between the air filling channel 52 and the importing pipe 11. The output end of the Venturi nozzle 9 is inserted into an input end of the importing pipe 11. The Venturi nozzle 9 has its output end contracted with respect to the input end in terms of diameter, so that water when flowing through the Venturi nozzle 9 is forced to speed up and then goes to the importing pipe 11 with the increased speed. Thereby, a negative pressure is produced in the importing pipe 11 and the air filling channel 52. Consequently, the air pressure outside the first vessel 1 resists the spring force of the first spring 7 and pushes the piston member 6 to open the air supplement hole b for air supplement.

Further, a second seal ring 82 is provided between the input end of the Venturi nozzle 9 and the output end of the water filling channel 51, so as to achieve seal connection. The Venturi nozzle 9 is peripherally provided with plural retaining bulges 91. The adjacent retaining bulges 91 are separated by a vent gap 92. The lower end of the water filling channel 51 and the upper end of the importing pipe 11 are held between the upper and lower surfaces of the retaining bulges 91, so that the Venturi nozzle 9 is retained in position, and the positional stability of the installed Venturi nozzle 9 can be ensured. Also, the vent gaps 92 ensure the communication between the air filling channel 52 and the importing pipe 11.

In some embodiments of the water-air supplement mechanism, the installation cover 5 is laterally provided with a water-filling pipe connector 54 that is axially communicated with the water supplement hole a, and is configured to connect the water-filling pipe d of the pressure-assisted toilet flush system. Since the water-filling pipe connector 54 is configured on the lateral of the installation cover 5, the upper end of the water-filling pipe d when being connected is posed horizontally, and not protruding from the upper end surface of the first vessel 1.

Further, the installation socket 12 is laterally provided with a retaining notch 14, and a connecting portion 55 connected between the water-filling pipe connector 54 and the installation cover 5 is inlaid into the retaining notch 14, so that the installation cover 5 is fit and retained in the installation socket 12. Afterward, screws can be used to fix the installation cover 5 into the installation socket 12, and the structure is so assembled.

In some embodiments of the water-air supplement mechanism, the installation cover 5 is at its lower end surface circularly formed with a stair 56 for a third seal ring 83 to be mounted therearound. When the installation cover 5 and the installation socket 12 are assembled, the third seal ring 83 is closely fit between installation cover 5 and the lateral wall of the installation socket 12, thereby achieving seal fit.

The importing pipe 11 defines therein a third circular incline 15. The third circular incline 15 radially contracted along the input direction. In other words, the importing pipe 11 also has a necking design, so as to increase the flow speeds of the water and air in the importing pipe 11.

Figure 5:
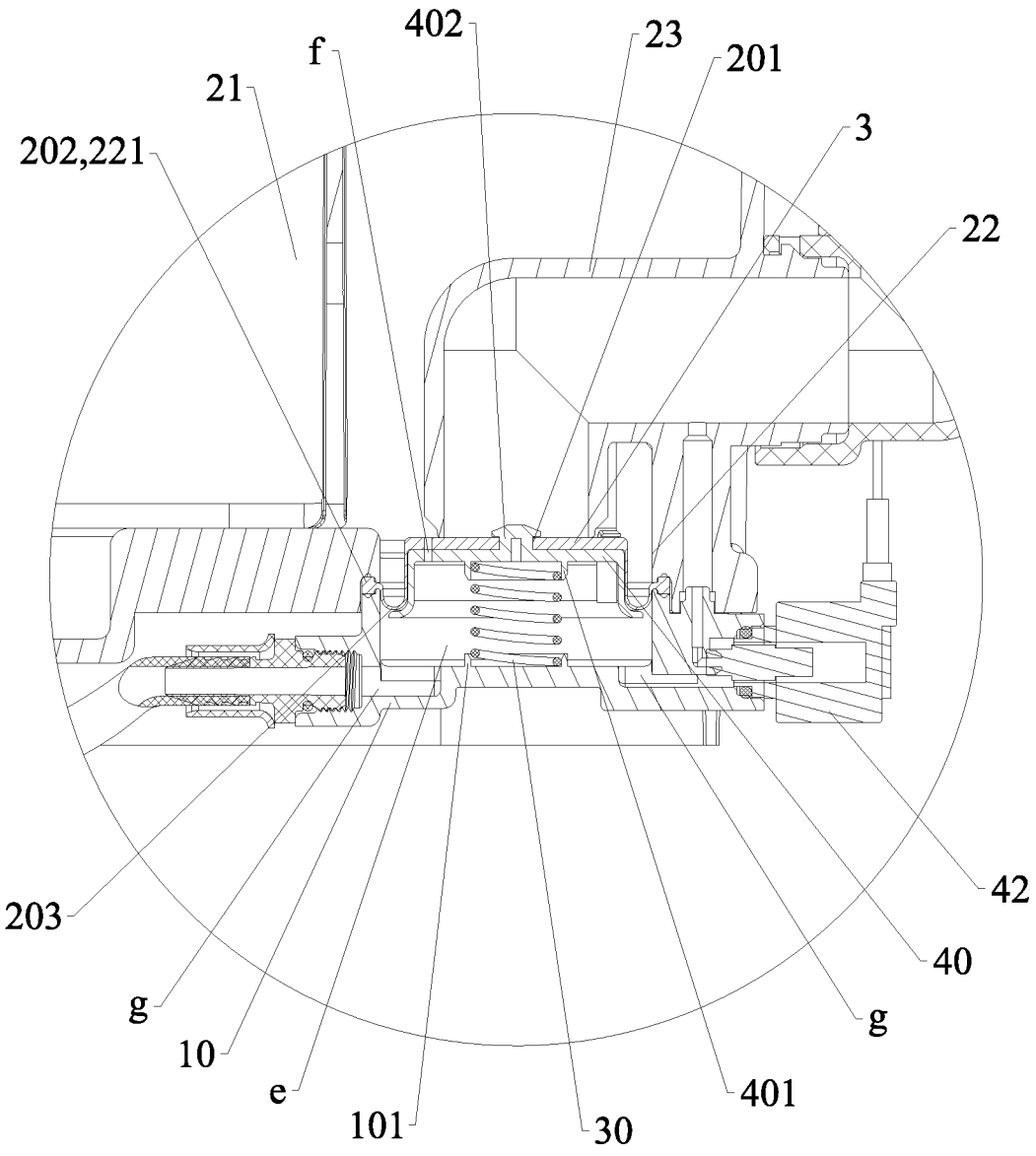
FIG. 5 is a local, close-up view of Circle B in FIG. 2.

Referring to FIG. 5, the water drainage mechanism comprises a bottom cover 10 and a membrane 20. The second vessel 2 has a water storage chamber 21, a water drainage pit 22, and a drainpipe 23. The water drainage pit 22 sinks into a bottom of the second vessel 2, and has its internal upper wall communicated with the water storage chamber 21 and the drainpipe 23, respectively. The water outlet c is located at an output end of the drainpipe 23. The bottom cover is installed in seal connection at an opening of the water drainage pit 22. The membrane 20 is movably fit at where the water drainage pit 22 is communicated with the drainpipe 23, and works with the bottom cover 10 to define a back-pressure chamber e. The back-pressure chamber e has a water supplement aperture f communicating the back-pressure chamber e with the water storage chamber 21. The back-pressure chamber e further has at least one drain outlet g communicated with the control mechanism. When the water storage chamber 21 feeds water, the water enters the back-pressure chamber e through the water supplement aperture f to increase a pressure in the back-pressure chamber e. When the drain outlet g is open, the back-pressure chamber e drains water to decrease the pressure so that the membrane 20 varies with the pressure in the back-pressure chamber e to come close to or go away from the drainpipe 23, thereby closing or opening the drainpipe 23. The water drainage mechanism provides the following improvements:

1. With the membrane 20 movably installed in the water drainage pit 22, a back-pressure chamber e is defined between the membrane 20 and the bottom cover 10. The back-pressure chamber e has a drain outlet g. When the back-pressure chamber e releases the pressure therein, the water pressure in the water storage chamber 21 will push the membrane 20 to depart from the drainpipe 23, thereby creating a water passage between the water storage chamber 21 and the drainpipe 23. Then the water storage chamber 21 can start to drain. The supplied water first enters the water storage chamber 21 and props open the membrane 20 to enter the drainpipe 23. No matter how the water filling pressure acting on the second vessel 2 changes, the water always provides a pushing force to open the membrane 20 while flowing to the drainpipe 23. This ensures the stability of water drainage from the water tank despite of changes in the water supply pressure and in the flow rate.
2. The presence of the water supplement aperture f ensures timely water supplement to the back-pressure chamber e after water drainage no matter how the membrane 20 changes, so that the pressure in the back-pressure chamber e can restore to its initial level to push the membrane 20 cut the communication between the water drainage pit 22 and the drainpipe 23.
3. The overall drainage of the second vessel 2 is arranged at the bottom, and the connecting pipes may be arranged on the lateral of the second vessel 2, thereby minimizing the overall height of the dual water-vessel flush structure and allowing the system to fit in an installation space with a relatively low profile.

In some embodiments of the water drainage mechanism, the water drainage mechanism further comprises a second spring 30 received in the back-pressure chamber e. The second spring 30 serves to return the membrane 20 toward the drainpipe 12. The presence of the second spring 30 ensures that the membrane 20 will not completely attach to the bottom cover 10 during water drainage and prevents water supplement of the back-pressure chamber e, and ensures that the membrane 20 can return to its normal position after water drainage, thereby promising the functional reliability of the water drainage structure even after repeated operation.

Further, the water drainage mechanism comprises a movable seat 40 for receiving the membrane 20. The second spring 30 is configured between the bottom cover 10 and the movable seat 40. The presence of the movable seat 40 helps maintain the shape of the central part of the membrane 20, so as to ensure that when moving toward the drainpipe 23 in response to the pressure of the back-pressure chamber e and the acting force of the second spring 30, the membrane 20 can reliably block the water-filling end of the drainpipe 23, thereby preventing water leakage except for intended water drainage.

Moreover, the bottom cover 10 and the movable seat 40 having their opposite surfaces provided with a first projecting ring 101 and a second projecting ring 401, respectively. The second spring 30 has its two ends inlaid in the first projecting ring 101 and the second projecting ring 401, respectively, so that the second spring 30 is fixed inside the back-pressure chamber e and prevented from losing its function of returning the membrane 20 that might otherwise be caused by its displacement during repeated compression/restoration.

Furthermore, the movable seat 40 is at its surface provided with retaining posts 402, and the membrane 20 is formed with retaining holes 201 matching the retaining posts 402. When the retaining posts 402 are inlaid in the respective retaining holes 201, relative positioning between the membrane 20 and the movable seat 40 can be achieved.

At last, the water supplement aperture f passes through the membrane 20 and the movable seat 40. Since the diameter of the water supplement aperture f directly determines the flow from the water storage chamber 21 to the back-pressure chamber e, adjustment of the water supplement duration is achievable by changing the diameter of the water supplement aperture f to meet different user needs. With the water supplement aperture f placed on the membrane 20 and the movable seat 40, dimensional change in the water supplement aperture f can be promptly achieved by replacing the membrane 20 and the movable seat 40 with their alternative counterparts, thereby satisfying various user needs while saving manufacturing costs.

In some embodiments of the water drainage mechanism, the water drainage pit 22 has a retaining recess 221 circularly formed on its lateral wall, the membrane 20 has a retaining ring 202 formed along its rim. The bottom cover 10 presses the retaining ring 202 down to the retaining recess 221, so that the membrane 20 is installed in the second vessel 2. Additionally, the membrane 20 is provided with at least one circle of deformable creases 203. The creases 203 ensure the membrane 20 with the ability to deform in response of an external force.

In some embodiments of the water drainage mechanism, the drain outlet g is configured on the lateral of the bottom cover 10. As compared to the second vessel 2, the bottom cover 10 is a component easier to be replaced. By placing the drain outlet g on the bottom cover 10, the number of the drain outlets g can be changed according to user needs by replacing an alternative bottom cover 10 having a different number of the drain outlets g. Additionally, by placing the drain outlet g laterally on the bottom cover 10, pipes can be transversely connected without turns, thereby preventing increase of the overall height.

The drain outlet g may be one or more depending on the control means used, so as to satisfy different user needs.

Further, the control mechanism comprises at least one of a switch valve 41 and a solenoid valve 42. Where both the switch valve 41 and the solenoid valve 42 are used, they are connected to different drain outlets g, respectively;

(1) Where the control mechanism is realized using a switch valve 41, the switch valve 41 acts as the "control switch" of the drain outlet g. The switch valve 41, when being operated, can drain the water in the back-pressure chamber e through the drain outlet g, so that the pressure in the back-pressure chamber e decreases, thereby making the membrane 20 depart from the water-filling end of the drainpipe 23 for water drainage.

(2) Where the control mechanism is realized using a solenoid valve 42, the solenoid valve 42 has its water-filling end communicated with one of the drain outlets g, while its water-outputting end is communicated with the drainpipe 23. When the solenoid valve 42 works, direct conduction between the drain outlet g (meaning the back-pressure chamber e) and the drainpipe 23 is achieved, and the water in the back-pressure chamber e can be output to the drainpipe 23, so that the pressure in the back-pressure chamber e decreases, thereby making the membrane 20 depart form the water-filling end of the drainpipe 23 for water drainage. Given that the solenoid valve 42 supports wireless, remote control, monetary costs and spatial occupancy for pipe connection can be saved by directly connecting the water-outputting end of the solenoid valve 42 to the drainpipe 23. In this case, instead of additional pipe connection, water passage may be directly formed inside the second vessel 2.

The pressure-assisted toilet flush system further comprises a water split box 50. The output end of the control mechanism and the output end of the water drainage mechanism are both communicated with the water split box 50. The water split box 50 is provided with at least two drainage connectors 501. The two drainage connectors 501 are used to communicate the primary flushing pipe and the rinsing water pipe of the sitting toilet. The presence of the water split box 50 simplifies outgoing connection of the exporting pipe of the water drainage mechanism, and provides the possibility of supplying water to different water routes according to practical needs.

Figure 6:
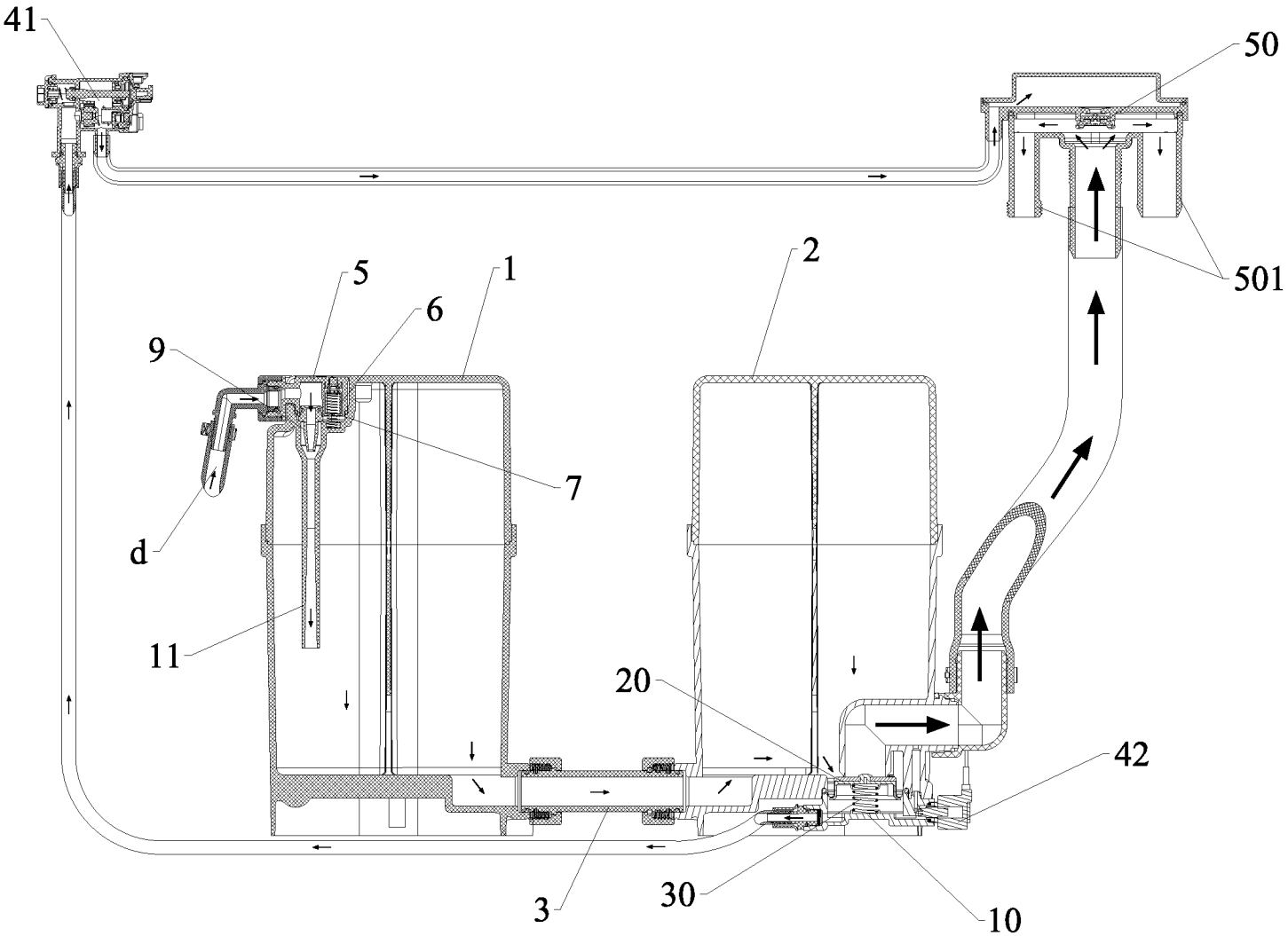
FIG. 6 is a schematic drawing illustrating the route of water in the pressure-assisted toilet flush system according to an embodiment of the present invention.

Referring to FIG. 5 and FIG. 6, the working principle of the pressure-assisted toilet flush system is described below.

During water filling, the water-filling pipe d feeds water to the first vessel 1, and the first vessel 1 starts to receive air supplement and water supplement. Meanwhile, the communicating pipe 3 supplements air and water to the second vessel 2. The air is gradually compressed while being stored in the upper parts of the first vessel 1 and the second vessel 2. In the second vessel 2, the water flows into the back-pressure chamber e through the water supplement aperture f, and gradually pushes the membrane 20 to move toward the drainpipe 23, until the membrane 20 blocks the water-filling end of the drainpipe 23. At the same time, the air in the first and second vessels 1, 2 is compressed to make the pressure in the vessels increase, until it reaches balance with the water pressure in the water-filling pipe d, at which time the water filling process is completed.

For water drainage, the switch valve 41 or the solenoid valve 42 is operated to open the drain outlet g, so the water in the back-pressure chamber e is output to the water split box through the drain outlet g. As a result, the pressure in the back-pressure chamber e decreases, and the water pressure in the water storage chamber 21 pushes the membrane 20 to open the water-filling end of the drainpipe 23, thereby allowing water drainage. As the drainpipe 23 outputs water, the pressure in the first and second vessels 1, 2 decreases, so the water-filling pipe d starts to supply water to the first vessel 1, which water is in turn fed to the back-pressure chamber e through the water supplement aperture f for water supplement. At this time, the drain outlet g is closed, and the back-pressure chamber e receives water supplement, so as to make the membrane 20 return to the drainpipe 23 slowly. Then upon expiration of the predetermined water drainage duration (determined by designing the diameter of the water supplement aperture f and the capacity of the back-pressure chamber e), the membrane 20 blocks the drainpipe 23 again, and water drainage is finished.

The embodiments and drawings provided in the disclosure are not intended to limit the forms and makes of products according to the present invention. All appropriate alternations and modifications apparent to people having ordinary skill in the art shall be considered as not departing from the scope of the present invention.

What is claimed is:

1. A dual water-vessel flush structure, comprising:

a first vessel, a second vessel, and a communicating pipe;

the first vessel at an upper part thereof provided with a water supplement hole and an air supplement hole; the second vessel at a lower part thereof provided with a water outlet, and the first vessel at a bottom of a lateral thereof communicated with a bottom of a lateral of the second vessel through the communicating pipe;

whereby for water supplement, water flows into the first vessel through the water supplement hole, and air flows into the first vessel through the air supplement hole, so that the water and the air mix together before flowing into the second vessel through the communicating pipe, and the air is gradually compressed while being stored in the upper parts of the first and second vessels; and for water drainage, the compressed air pushes the water in the first vessel to flow into the second vessel through the communicating pipe and pushes the water in the second vessel to drain through the water outlet.

2. The dual water-vessel flush structure of claim 1, wherein:

the water supplement hole is configured at a top of the lateral of the first vessel, and the air supplement hole is configured on an upper end surface of the first vessel, and the water outlet is configured at the bottom of the lateral of the second vessel.

3. The dual water-vessel flush structure of claim 2, further comprising:

an importing pipe configured inside the first vessel and extending to a lower part of the first vessel, wherein the water supplement hole and the air supplement hole are both communicated with the importing pipe.

4. A pressure-assisted toilet flush system, comprising the dual water-vessel flush structure of claim 2, and further comprising:

a water-air supplement mechanism, a water drainage mechanism, and a control mechanism;

the water supplement hole and the air supplement hole both leading to the first vessel through the water-air supplement mechanism;

the water drainage mechanism being configured at the water outlet, and interacting with the control mechanism; and the control mechanism working to activate the water drainage mechanism to perform water drainage at the water outlet.

5. The dual water-vessel flush structure of claim 1, further comprising:

an importing pipe configured inside the first vessel and extending to a lower part of the first vessel, wherein the water supplement hole and the air supplement hole are both communicated with the importing pipe.

6. The dual water-vessel flush structure of claim 1, wherein:

the communicating pipe has a diameter not smaller than 15 mm.

7. A pressure-assisted toilet flush system, comprising the dual water-vessel flush structure of claim 6, and further comprising:

a water-air supplement mechanism, a water drainage mechanism, and a control mechanism;

the water supplement hole and the air supplement hole both leading to the first vessel through the water-air supplement mechanism;

the water drainage mechanism being configured at the water outlet, and interacting with the control mechanism; and the control mechanism working to activate the water drainage mechanism to perform water drainage at the water outlet.

8. A pressure-assisted toilet flush system, comprising the dual water-vessel flush structure of claim 1, and further comprising:

a water-air supplement mechanism, a water drainage mechanism, and a control mechanism;

the water supplement hole and the air supplement hole both leading to the first vessel through the water-air supplement mechanism;

the water drainage mechanism being configured at the water outlet, and interacting with the control mechanism; and the control mechanism working to activate the water drainage mechanism to perform water drainage at the water outlet.

9. The pressure-assisted toilet flush system of claim 8, wherein:

the water-air supplement mechanism comprises an installation cover, a piston member, and a first spring; the first vessel having an upper end surface depressing to form an installation socket, the installation socket having a bottom connected to the importing pipe; the installation cover being in seal fit with a lateral wall of the installation socket, and having an upper end surface not higher than an upper end surface of the first vessel.

10. The pressure-assisted toilet flush system of claim 9, wherein:

the installation cover covers a water filling channel and an air filling channel that are vertically posed abreast, the water supplement hole configured on a lateral wall of the water filling channel, the air supplement hole configured at an upper end of the air filling channel, the air filling channel having a lower end communicated with the importing pipe; the piston member movably fit inside the air filling channel; the first spring configured between the piston member and a bottom wall of the installation socket, so that a difference of pressures inside and outside the first vessel and a spring force from the first spring jointly move the piston member along and inside the air filling channel, thereby opening or closing the air supplement hole.

11. The pressure-assisted toilet flush system of claim 10, wherein:

the water-air supplement mechanism further comprises a Venturi nozzle inlaid at an output end of the water filling channel, in which the Venturi nozzle does not block communication between the air filling channel and the importing pipe, and an output end of the Venturi nozzle is inserted into an input end of the importing pipe.

12. The pressure-assisted toilet flush system of claim 8, wherein:

the water drainage mechanism comprises a bottom cover and a membrane; the second vessel having a water storage chamber, a water drainage pit, and a drainpipe; the water drainage pit sinking into a bottom of the second vessel, and having an internal upper wall communicated with the water storage chamber and the drainpipe, respectively, the water outlet located at an output end of the drainpipe; the bottom cover installed in seal connection at an opening of the water drainage pit; the membrane movably fit at where the water drainage pit is communicated with the drainpipe, and working with the bottom cover to define a back-pressure chamber; the back-pressure chamber having a water supplement aperture communicating the back-pressure chamber with the water storage chamber, the back-pressure chamber further having at least one drain outlet communicated with the control mechanism, whereby when the water storage chamber feeds water, the water enters the back-pressure chamber through the water supplement aperture to increase a pressure in the back-pressure chamber, and when the drain outlet is open, the back-pressure chamber drains water to decrease the pressure so that the membrane varies with the pressure in the back-pressure chamber to come close to or go away from the drainpipe, thereby closing or opening the drainpipe.

13. The pressure-assisted toilet flush system of claim 12, wherein:

the water drainage mechanism further comprises a second spring received in the back-pressure chamber, and a movable seat for receiving the membrane, in which the second spring is configured between the bottom cover and the movable seat, for returning the membrane toward the drainpipe.

14. The pressure-assisted toilet flush system of claim 8, wherein:

the control mechanism comprises at least one of a switch valve and a solenoid valve.

15. The pressure-assisted toilet flush system of claim 8, further comprising:

a water split box, with which an output end of the control mechanism and an output end of the water drainage mechanism are communicated, wherein the water split box is provided with at least two drainage connectors for communicating a primary flushing pipe and a rinsing water pipe of a sitting toilet.

* * * * *